US009339096B2

(12) United States Patent
Thorpe et al.

(10) Patent No.: US 9,339,096 B2
(45) Date of Patent: May 17, 2016

(54) CUTICLE CARE SYSTEM

(71) Applicant: HCT Packaging, Inc., Bridgewater, NJ (US)

(72) Inventors: Timothy Thorpe, Santa Monica, CA (US); Armando Villarreal, Santa Monica, CA (US); Megan Rene Langdon, Santa Monica, CA (US)

(73) Assignee: HCT PACKAGING, INC., Bridgewater, NJ (US)

( * ) Notice: Subject to any disclaimer, the term of this patent is extended or adjusted under 35 U.S.C. 154(b) by 488 days.

(21) Appl. No.: 13/773,299

(22) Filed: Feb. 21, 2013

(65) Prior Publication Data

US 2014/0234003 A1 Aug. 21, 2014

(51) Int. Cl.
*A45D 29/16* (2006.01)
*A45D 34/04* (2006.01)

(52) U.S. Cl.
CPC ..... *A45D 29/16* (2013.01); *A45D 34/04* (2013.01); *A45D 2200/054* (2013.01)

(58) Field of Classification Search
CPC combination set(s) only.
See application file for complete search history.

(56) References Cited

U.S. PATENT DOCUMENTS

| | | | | |
|---|---|---|---|---|
| 1,362,601 | A * | 12/1920 | Chandler | 132/74.5 |
| 2,512,100 | A * | 6/1950 | Haber | 132/74.5 |
| 4,292,986 | A | 10/1981 | Ergaver et al. | |
| 4,681,791 | A | 7/1987 | Shibahashi et al. | |
| 5,153,066 | A | 10/1992 | Tanaka et al. | |
| 5,316,513 | A | 5/1994 | Nakagawa et al. | |
| 5,334,421 | A | 8/1994 | McNutt | |
| 5,447,167 | A | 9/1995 | Fleischaker | |
| 6,024,101 | A | 2/2000 | Garner | |
| 6,180,741 | B1 | 1/2001 | Yamaguchi et al. | |
| 6,202,242 | B1 | 3/2001 | Salmon et al. | |
| 6,254,996 | B1 | 7/2001 | Fukuda et al. | |
| 6,506,327 | B2 | 1/2003 | Weihrauch | |
| 6,596,203 | B1 | 7/2003 | Au et al. | |
| 6,761,969 | B2 | 7/2004 | Li et al. | |
| 6,957,468 | B2 | 10/2005 | Driesen et al. | |
| 7,073,902 | B2 | 7/2006 | Codos et al. | |
| 7,096,598 | B1 | 8/2006 | Myatt | |
| 7,201,527 | B2 * | 4/2007 | Thorpe et al. | 401/269 |
| 7,448,111 | B2 | 11/2008 | Bigio | |
| 7,476,048 | B2 * | 1/2009 | Prague | 401/262 |
| 7,727,634 | B2 | 6/2010 | Yacovone | |
| 7,766,440 | B2 | 8/2010 | Kusunoki | |

(Continued)

FOREIGN PATENT DOCUMENTS

| | | |
|---|---|---|
| KR | 200398534 | 10/2005 |
| KR | 2020120003955 | 6/2012 |
| WO | WO0108529 | 2/2001 |

OTHER PUBLICATIONS

The PCT Search Report and Written Opinion mailed May 26, 2014 for PCT application No. PCT/US14/13297, 14 pages.

*Primary Examiner* — David Walczak
(74) *Attorney, Agent, or Firm* — Seager, Tufte & Wickhem LLP

(57) ABSTRACT

An applicator system for dispensing a product and/or operating on a cuticle of a user includes a housing having a reservoir for storing a product, such as a cosmetic product or a medicinal product and a cuticle care tip. The cuticle care tip comprises one of a variety of surfaces configured to operate on a user and/or apply the product. The applicator system also includes a product delivery mechanism for dispensing the product.

20 Claims, 5 Drawing Sheets

(56) References Cited

U.S. PATENT DOCUMENTS

| | | | | |
|---|---|---|---|---|
| 8,074,666 | B2 | 12/2011 | Piao | |
| 8,136,536 | B2 | 3/2012 | Bickford | |
| 8,161,983 | B1 * | 4/2012 | Lee | 132/324 |
| 8,360,674 | B2 * | 1/2013 | Dwyer | 401/278 |
| 8,662,089 | B2 * | 3/2014 | Hwang | 132/74.5 |
| 2005/0000534 | A1 | 1/2005 | Tien | |
| 2008/0309017 | A1 | 12/2008 | Mattice | |
| 2012/0294666 | A1 | 11/2012 | Jang | |

* cited by examiner

CUTICLE CARE SYSTEM

BACKGROUND

An individual may utilize multiple items when properly caring for each cuticle at the base of each fingernail or toenail. For example, an individual may routinely utilize multiple items configured for a single operation, such as pushing back, sculpting, massaging or trimming the cuticle as the nail continues to grow. Additionally, the individual may apply a product or solution to the cuticle to prevent the cuticle from becoming dry and torn. However, carrying multiple items may be inconvenient, particularly when traveling, due to the amount of space taken up by the multiple items.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

This application describes dispensers having a housing coupled to an applicator. In some implementations, the housing comprises a first portion containing a reservoir for storing a cosmetic and/or medicinal product, such as lotion or oil, and a second portion comprising a product delivery mechanism. The applicator configured to interact with a surface, such as a cuticle at the base of a fingernail and/or toenail. For example, each applicator may have one of a plurality of tips or tools configured to push back, trim, massage, sculpt, and/or manipulate a cuticle at the base of a user's fingernail and/or toenail. Furthermore, each of the plurality of tips may have an application surface comprising various metals, glass, stone, ceramics, composites, and/or other materials. The product may be dispensed via the product delivery mechanism from the reservoir in the housing through a passageway terminating at an opening disposed on the application surface on each applicator for placement of the product on a user's cuticle/nail bed.

By combining the dispenser with the applicator comprising the cuticle tip or tool, according to the implementations described herein, the cosmetic and/or medicinal product may be applied directly to the surface that is being massaged, abraded, or worked on. This may allow the product to be better worked into the tissue than existing processes.

Illustrative Dispenser with Example Tips

Figure 1A:
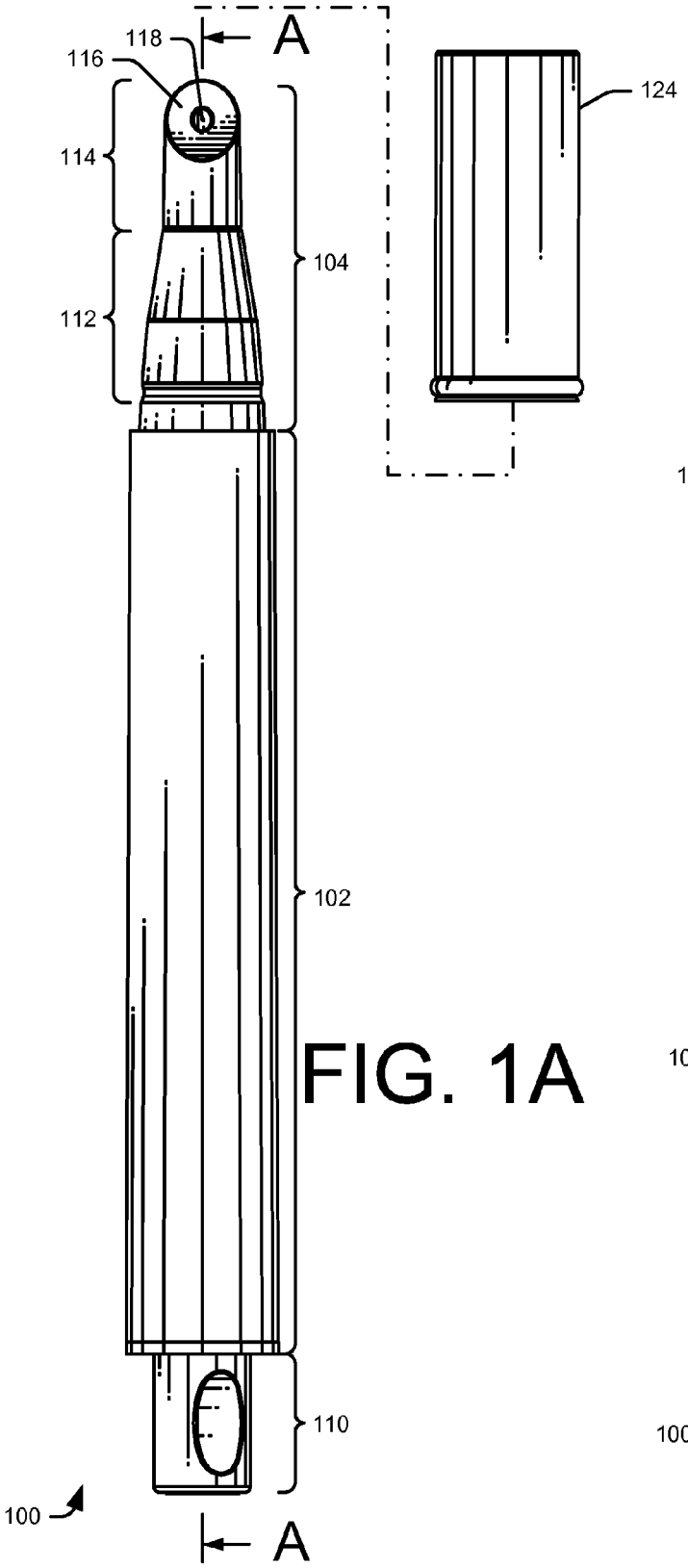
FIGS. 1A and 1B depict a first illustrative example of a cuticle tip applicator with a pen click delivery mechanism.

FIGS. 1A-4B illustrate various example dispensers, where each dispenser contains one of a plurality of housing and tip configurations. FIG. 1A depicts a first illustrative example of a cuticle tip dispenser 100. The cuticle tip dispenser 100 includes a housing 102 and an applicator 104. The housing 102 may be formed using one or more of metal, plastic (e.g., polypropylene (PP), acrylonitrile butadiene styrene (ABS), or polyoxymethylene (POM), ceramic, glass, wood, stone, any combination of the preceding or other suitable material.

Figure 1B:
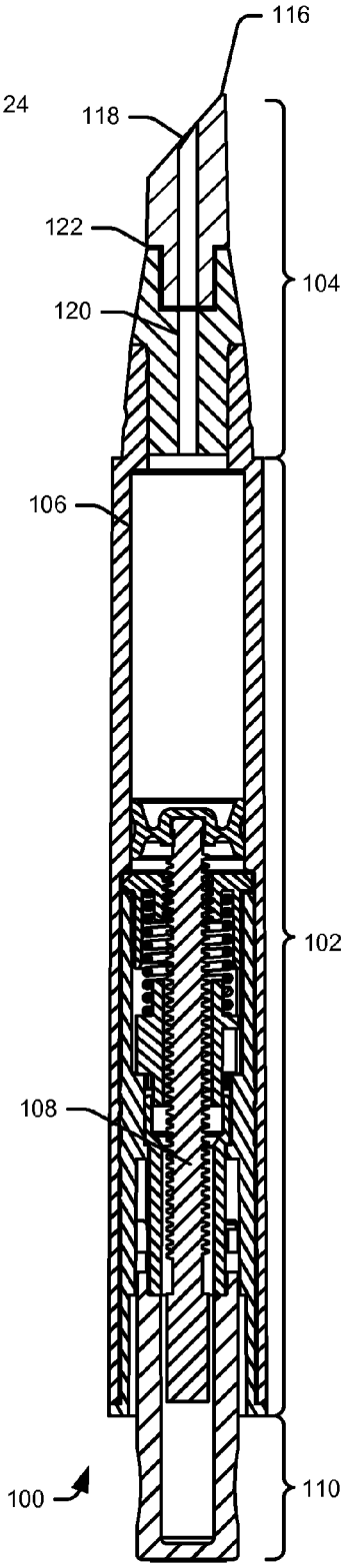

As illustrated in FIGS. 1A and 1B, the housing 102 may contain reservoir 106 for storing a product. Reservoir 106 may encompass the entire housing 102. In other implementations, the reservoir may encompass only a portion of the housing. In some implementations, the housing 102 may contain a delivery mechanism 108 to aid in delivery of the product. The product (including any other products described herein) may be oil, lotion, ointments or any other medicinal or cosmetic product suitable for application by a user. For example, the product may comprise one or more substances, such as aloe or lanolin, which provide a healing or therapeutic effect to heal damaged keratin or maintain healthy keratin. In addition, products may include therapeutic substances, such as topical anesthetics, analgesics, fragrances, menthol, or other substances that provide a soothing or stimulating sensation when applied to a user of the product. In addition to skin care substances, thermal treatments (e.g., application of heat and/or cold) are known to relieve pain, provide a therapeutic sensation, and to slow the body's natural response to injury so that a slower and more controlled healing process may ensue.

As illustrated in FIG. 1B, the dispenser 100 may contain a delivery mechanism 108 for dispensing the product such as pen click segment 110. The pen click refers to a method that allows a user to depress segment 110 which operates the delivery mechanism 108 within housing 102. Upon activation of segment 110, delivery mechanism 108 acts to dispense a corresponding volume of the product from reservoir 106.

In other implementations, the delivery mechanism for dispensing product may comprise an airless pump mechanism. The term airless pump refers to a pump that provides dispensing of a substance from a container under pressure in essentially a single direction without permitting reverse (intake) flow of air via the pump. That is, as product is pumped from the reservoir 106, the pumped product is not replaced with a corresponding volume of air through the pump. In addition to preventing reverse intake flow of air, an airless pump typically does not allow intake of any other substances to replace the volume of product pumped out of the reservoir 106. For example, an airless pump could include a one-way valve, such as a check valve.

In yet another implementation, a delivery mechanism for dispensing the product may comprise a pressurized dispenser, such as an aerosol dispenser. In certain implementations where the delivery mechanism is an aerosol delivery mechanism, the product will be held under pressure in the reservoir and will be dispersed along with an aerosol propellant in response to actuation by a user. Actuation may be by depressing, rotating, tilting, or otherwise manipulating a portion of the dispenser housing, pressing a button, and/or by any other suitable dispensing mechanism. Details of the construction and propellant of an aerosol dispenser are within the skill of one of ordinary skill in the art and will, therefore, not be described in detail herein. Other delivery mechanisms will be discussed in detail below with reference to other implementations.

FIGS. 1A and 1B illustrate applicator 104 which may be affixed to the housing 102. The applicator 104 may include a neck 112 coupled to the housing and an tip 114 coupled to the neck. The tip 114 may include an application surface 116 configured to apply a product to a surface on a user. For example, the application surface 116 may be used to apply the product to the nails or cuticle of a user. As illustrated in FIG. 1A, application surface 116 is shown having generally circular or ovoid configuration. However, in other implementations, the application surface may be configured in any other shape, such as a square, triangle, rectangle, trapezoid, or the like.

In some implementations, application surface 116 of tip 114 may include, but are not limited to, different surface treatments (e.g., siping, slitting, etc.), abrasive surface finishes/textures (e.g., macro-, micro-, or nano-structures, etc.), abrasive coatings, and/or contours (e.g., rounded, ribbed, protrusions, fingers, etc.) to provide massaging and/or scrubbing effectiveness.

The application surface 116 may have an opening or orifice 118 for delivery of the product to the application surface 116 of tip 114. Orifice 118 on the application surface 116 of tip 114 may be the terminal end of a delivery passageway 120 originating at the reservoir 106 in the housing 102. As described above, the product may be moved from the reservoir 106 through the delivery passageway 120 towards the orifice 118 by any one of the delivery mechanisms described herein. The delivery passageway 120 may be made of a material which is non-reactive or resistant to the product contained with the reservoir 106. In the illustrated implementation, the delivery passageway 120 comprises a through-hole or bore extending through the neck 112 and tip 114. However, in other implementations, an insert or liner may extend part of or all of the way from the reservoir 106 to the orifice 118 on the application surface 116. In that case, the insert may be made of, for example, a thermoplastic polymer. In other implementations, the delivery passageway may be made of virtually any other material that is non-reactive or resistant to the product being dispensed, such as various metals, plastics, ceramics, composites, or the like. When present, the insert may in some implementations extend to the application surface 116, such that the insert is substantially flush with the application surface 116. In other implementations, the insert may be truncated, such that it terminates at a location recessed below the application surface.

Applicator 104 may be made of material which is non-reactive with or resistant to the product stored in the reservoir 106 such as various metals, wood, plastics, ceramics, glass, stone or the like. In some implementations, the applicator 104 may comprise material that is capable of retaining and/or transferring heat or cold during the application of the product. Examples of suitable materials include, without limitation, metals (e.g., aluminum, titanium, stainless steel, steel, carbon, carbon fiber, nickel, tin, copper, brass, alloys thereof, etc.), glass, ceramics, stone, high-density plastics, composites, or the like. Additionally or alternatively, applicator 104, including neck 112 and tip 114, may comprise or be coated with a material or substance that has antimicrobial, antiseptic, or antibacterial properties.

In some implementations, the neck 112 and tip 114 may be made of the same material, while in other implementations, they may be made of different materials. For instance, the neck 112 may be made of plastic, while the tip 114 may be made of ceramic, glass, store or other material capable of storing and/or transmitting thermal energy. In other examples, the neck may be made of metal, while the tip is made of ceramic, glass, or stone.

In some implementations, the neck 112 and tip 114 may be formed into one unified applicator 104 (i.e., may be made integrally). Fabrication of tip 114 and neck 112 of applicator 104 may be accomplished through a separate manufacturing process, a co-molding process, or any other suitable production process. In other implementations, tip 114 may be configured to detach from the neck 112 along line 122. For example, a user may first desire to utilize on dispenser 100 a first tip associated with the application surface for massaging a cuticle. Next, the user may desire to utilize a second tip on dispenser 100 to trim or push back the cuticle. To accomplish this, the user may remove the first tip associated with the massage application surface. The first tip may separate from the neck 112 of applicator 104 along line 122. The second tip may then be secured to the neck 112 of applicator 104 by, for example, a friction press-fit, snap-fit, adhesive, screw threads, magnetic coupling, and/or engagement by one or more engagement features.

As illustrated in FIG. 1A, the dispenser 100 may also include a cap 124 which may be temporarily mated (e.g., attached) to the housing 102 to protect the applicator 104 when the dispenser is not in use, to prevent debris from contacting the tip, or to prevent products on the reservoir from leaking on to surrounding articles. For example, the cap 124 may be placed over the applicator 104 to temporarily mate the cap 124 to the housing 102. The cap 124 may temporarily mate with the housing 102 to prevent the cap from inadvertently being removed. For example, the cap 124 may snap in place with the housing 102. As another example, the cap 124 and the housing 102 may have threads that enable the cap 124 to be screwed on to and unscrewed from the housing 102. Of course, other types of mechanisms may be used to temporarily mate the cap 124 to the housing 102.

Cap 124 is illustrated as having a generally cylindrical shape with substantially the same diameter as the housing 102. However, it should be understood that cap 124 (and any other cap described herein) may be any other suitable shape, such as having a substantially similar shape as the applicator, which may allow the cap to temporarily attach to housing as described above.

Figures 2A, 2B:
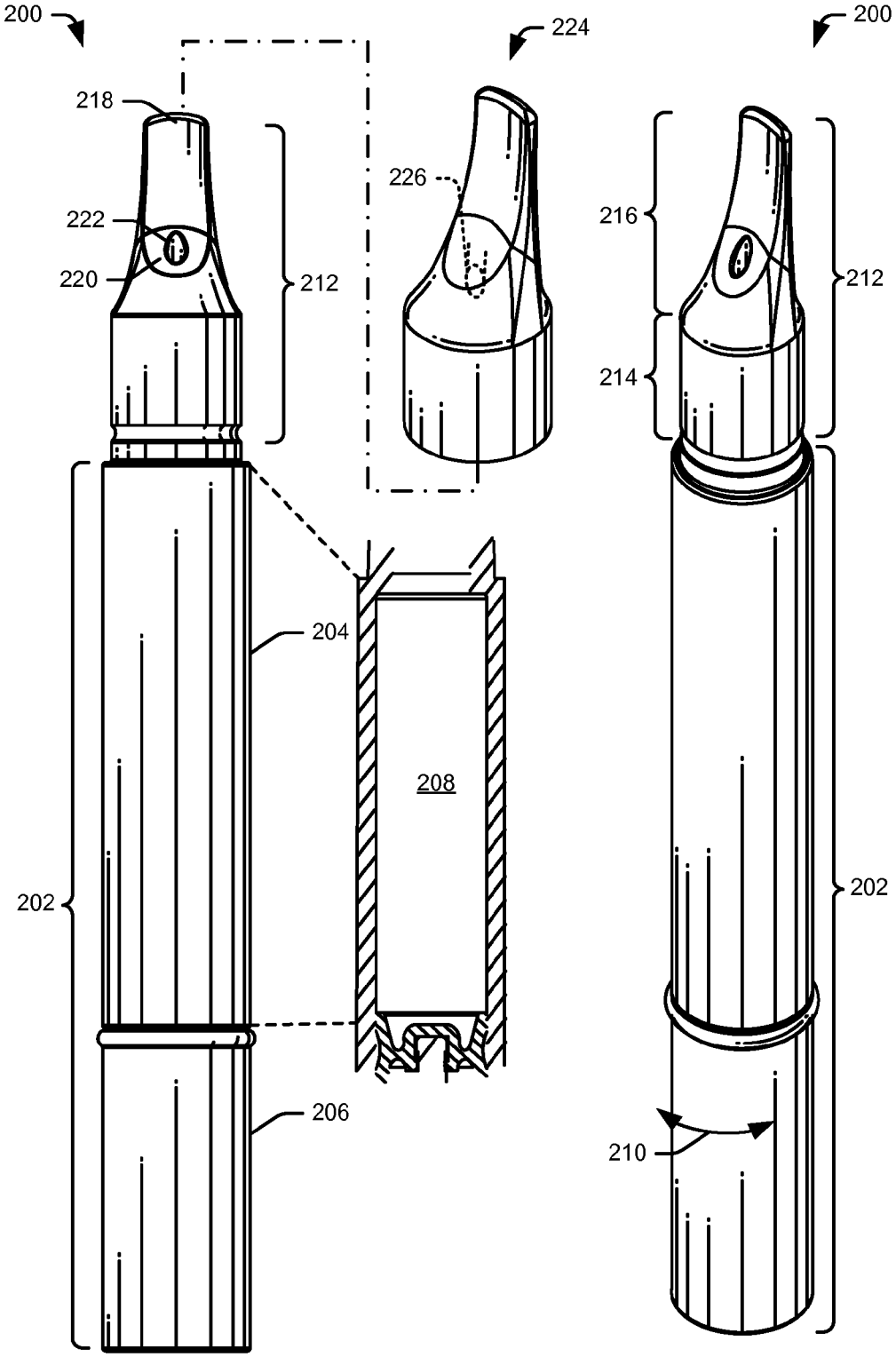
FIGS. 2A and 2B depict a second illustrative example of a cuticle tip applicator with a click/twist delivery mechanism.

FIGS. 2A and 2B illustrate another example cuticle care dispenser 200. Dispenser 200 is illustrated as containing housing 202 divided into a first portion 204 and a second portion 206. The first portion 204 of the housing 202 may comprise a reservoir 208 for containing a product. In some implementations, the second portion 206 of the housing 202 may contain a delivery mechanism to aid in delivery of the product.

As illustrated in FIG. 2B, the dispenser 200 may contain a delivery mechanism 210 using a click, a reverse click operation, twist or reverse twist operation, whereby the user may operate the dispenser by moving the second portion 206 of the housing relative to the first portion 204 of the housing in either a clockwise or counterclockwise direction. Whereby, clicking or twisting the second portion 206 may activate the delivery mechanism to move and/or push the product for the reservoir 208 through the delivery passageway (not shown). In some implementations, the delivery passageway may be configured as described above with regard to FIGS. 1A and 1B.

FIGS. 2A and 2B illustrate applicator 212 which may be coupled to the first portion 204 of the housing 202. Applicator 212 may include a neck 214 and a tip 216. In some implementations, as described above, the neck 214 and tip 216 may be formed as single unit. In other implementations, the tip 216 may be interchangeable with any other tips described herein. Tip 216 may contain a manipulation surface 218 configured to operate on a user's cuticle. For example, tip 216 may have manipulation surface configured as an apex for pushing back a cuticle toward the base of a fingernail/toenail of the user. As illustrated in FIGS. 2A and 2B, the apex of tip 216 is shown as a single apex, however, in other implementations, tip 216 may have multiple apexes, protrusions or projections. (e.g., two prongs). In some implementations, the manipulation surface may comprise a material that is non-reactive or resistant to the product in the dispenser and/or capable of retaining heat or cold during application of the product. For example, the manipulation surface of the tip may be made of, without limitation, metals (e.g., aluminum, titanium, stainless steel, steel, carbon, nickel, tin, copper, brass, alloys thereof, etc.), glass, stone, ceramics, high-density plastics, composites, or the like.

In some implementations, the tip 216 may also have an application surface 220 configured to allow the user to apply the product to the cuticle being operated on by the manipulation surface 218. The application surface 220 having an orifice 222, as described with reference to FIGS. 1A and 1B, for delivery of the product from the reservoir via the product delivery passageway.

FIG. 2A further illustrates dispenser 200 may contain cap 224. In some implementations, cap 224 may contain plug 226 to seal the orifice 222 at the terminal end of the product delivery passageway. The plug 226 may be made of a thermoplastic polymer or any other material which is non-reactive or resistant to the product being dispensed, such as various metals, plastics, ceramics, composites, or the like. Additionally or alternatively, the plug 226 may be elastomeric, such that when the cap 224 is in place the plug 226 may expand and deform somewhat to seal the product delivery passageway. Cap 224 is shown as having a shape similar to tip 216, however it can also have a generally cylindrical shape with substantially the same diameter as the housing 202 or any other suitable shape.

Figure 3A:
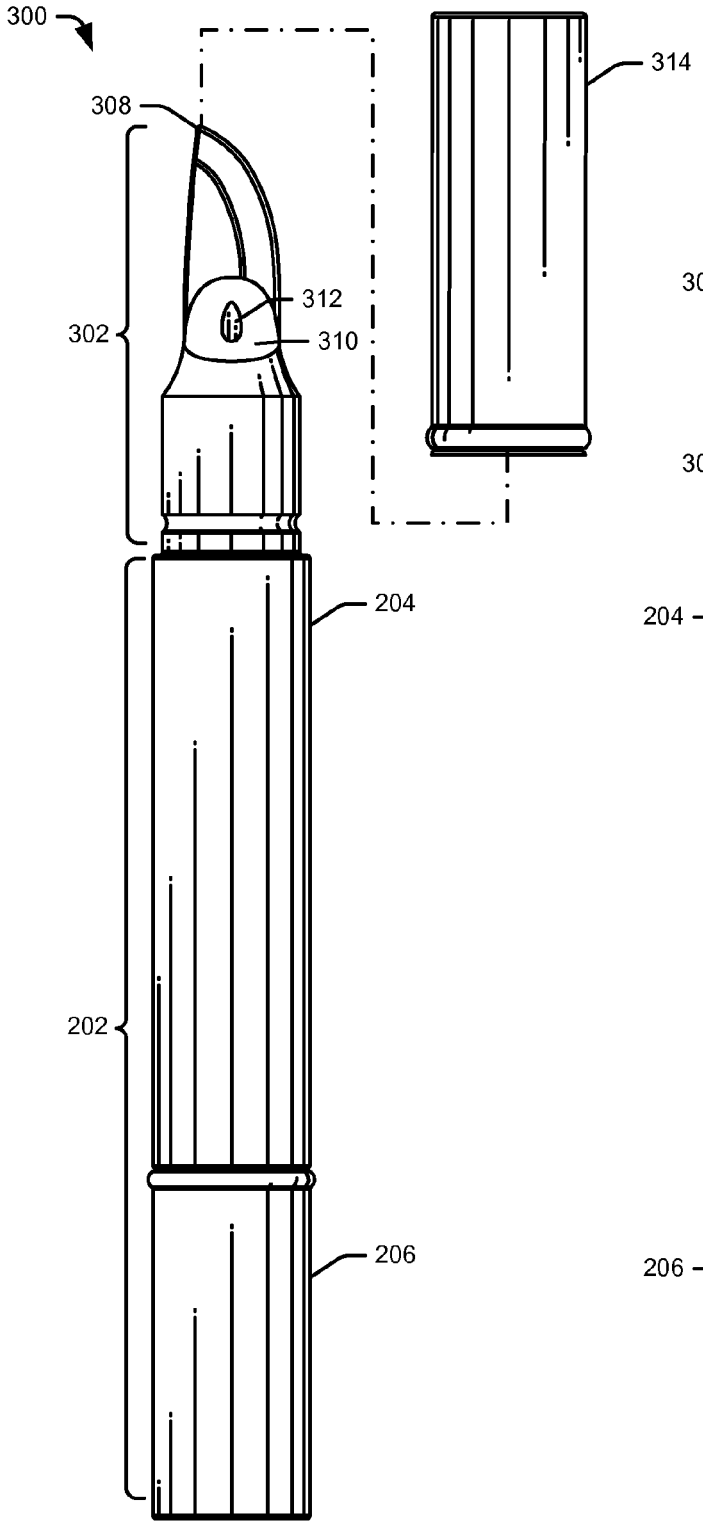
FIGS. 3A and 3B depict a third illustrative example of a cuticle tip applicator with a manipulation surface configured to trim or cut a cuticle.
Figure 3B:
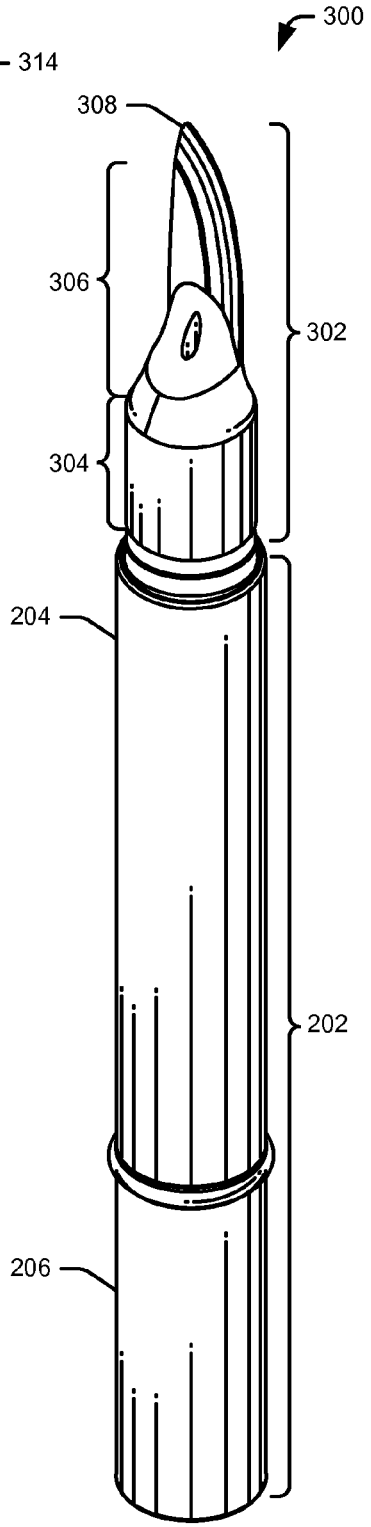

FIGS. 3A and 3B illustrate another example dispenser 300. As illustrated in FIGS. 3A and 3B, dispenser 300 contains housing 202 segmented into a first portion 204 and second portion 206. The first portion containing the reservoir for storing a product and the second portion containing a product delivery mechanism.

FIGS. 3A and 3B illustrate an applicator 302 coupled to the first portion 204 of the housing 202. Applicator 302 may include neck 304 and tip 306. Tip 306 may include a manipulation surface 308 configured to operate on a user. For example, the manipulation surface 308 may be configured to allow a user to trim or cut the cuticle at the base of a fingernail/toenail. As described above, the tip 306 may be interchangeable with any of the other tips herein. In some implementations, the applicator 302 may be made of virtually any material that is non-reactive or resistant to the product being dispensed, such as various metals, plastics, ceramics, composites, or the like.

In some implementations, tip 306 may contain an application surface 310 for applying the product. The application surface 310 having an opening or orifice 312 for delivery of the product to the application surface 310 and/or manipulation surface 308 of applicator 302. As described with reference to FIGS. 1A and 1B above, the orifice 312 is the terminal endpoint of the product delivery passageway.

FIG. 3A illustrates an example cap 314 constructed to temporarily attach to dispenser 300. Cap 314 may contain a plug as described with reference to FIG. 2B above. In some implementations, cap 306 may be configured, as with other caps described herein, to temporarily and removably attach to the second portion 206 of the housing 202 to prevent misplacement of cap 314 while the dispenser is in use.

Figure 4A:
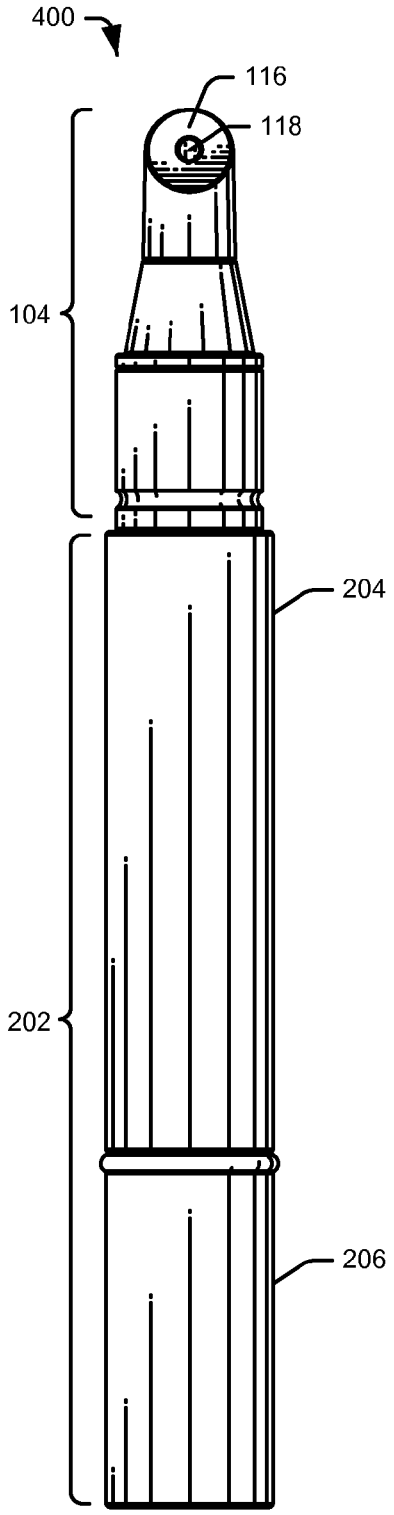
FIGS. 4A and 4B depict a fourth illustrative example of a cuticle tip applicator with a manipulation surface configured to massage a cuticle.
Figure 4B:
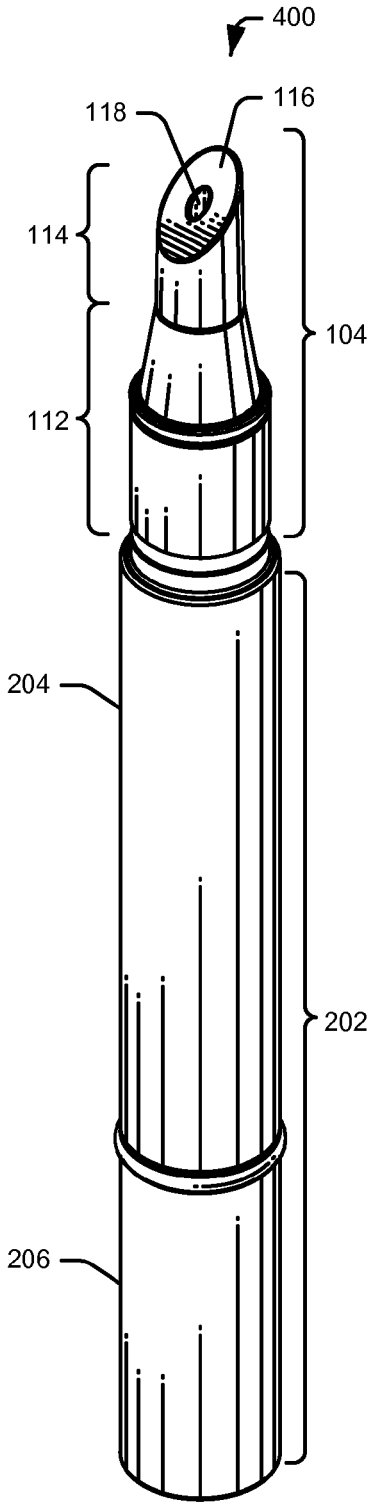

FIGS. 4A and 4B illustrate a fourth example dispenser 400. Dispenser 400 contains housing 202 segmented into a first portion 204 and second portion 206. The first portion containing the reservoir for storing a product and the second portion containing a product delivery mechanism as described with reference to FIGS. 2A and 2B.

FIGS. 4A and 4B illustrate an applicator 104 coupled to the first portion 204 of the housing 202. As described with reference to FIGS. 1A and 1B, applicator 104 may include neck 112 and tip 114. Tip 114 may include an application surface 116 configured to apply a product to a surface on a user. For example, the application surface 116 may be used to apply the product to the fingernails or cuticle of a user. The application surface 116 having an opening or orifice 118 for delivery of the product to the application surface 116 of tip 114. Orifice 118 is the terminal endpoint of the product delivery passageway which originates at the reservoir in the first portion 204 of the housing 202.

In some implementations, the dispenser 400 may include a cap as described above with reference to FIGS. 1A-3B.

Illustrative Dispenser with Squeeze Delivery Mechanism

Figure 5A:
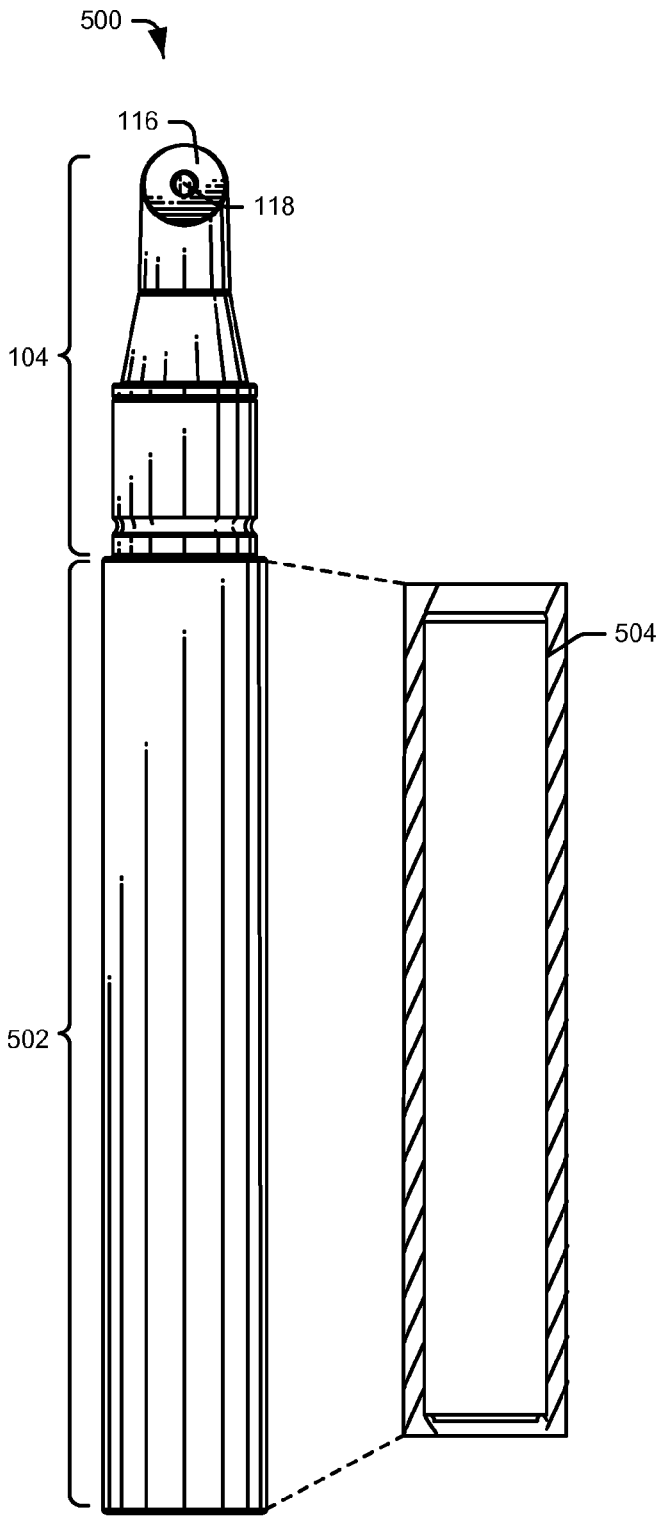
FIGS. 5A and 5B depict a fifth illustrative example of a cuticle tip applicator with a squeeze product delivery mechanism.
Figure 5B:
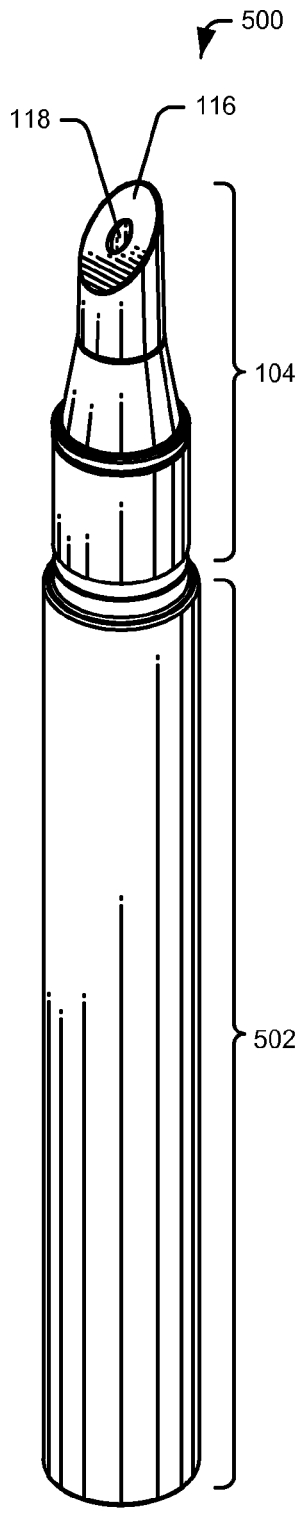

FIGS. 5A and 5B depicts a fourth illustrative implementation of a cuticle tip dispenser 500. Dispenser 500 contains outer shell or housing 502 coupled to applicator 104. In some implementations, the tip of dispenser 500 may be configured with one of tip 114 (as illustrated), tip 216 or tip 306 described above. In some implementations, the tips may be interchangeable on the applicator as described above.

As illustrated in FIG. 5A, housing 502 of dispenser 500 may contain reservoir 504 for storing a product. Without limitation, the product may be oil, lotion, ointments or any other medicinal or cosmetic solution suitable for application by a user as described above. In some implementations, a product delivery passageway may originate at the reservoir 504 and end at an orifice 118 on application surface 116 on applicator 104.

Housing 502 may contain a squeeze delivery mechanism to aid in delivery of the product from the reservoir 504 to the orifice 118 on applicator 104. In some implementations, housing 502 may be made of an elastomeric plastic to allow a user to distort housing 502 when pressure is applied by the user. In this implementation, the housing 502 would "bounce back" to the pre-distorted shape once the user relieves the pressure. For example, the squeeze delivery mechanism may operate when a user applies pressure to the housing 502. As a result, the housing 502 may distort the reservoir 504 causing the product contained within the reservoir 504 to travel via the delivery passageway toward the orifice 118 on the application surface 116 of applicator 104. In other implementations, housing 502 may be made of any material capable of distortion to allow a user to squeeze the product from the reservoir in the housing yet retaining their pre-distortion shape, such as, various plastics, carbon fiber, composites or the like.

In some implementations, the dispenser 500 may include a cap as described above with reference to FIGS. 1A-3B.

CONCLUSION

Although implementations have been described in language specific to structural feature, it is to be understood that the disclosure is not necessarily limited to the specific features or acts described. Rather, the specific features and acts are disclosed as illustrative forms of employing the implementations. For example, in various implementations, any of the structural features and/or methodological acts described herein may be rearranged, modified, or omitted entirely. For example, the shape, size, and configuration of the cuticle tip applicator housing, tips, necks, and delivery mechanisms may be varied.

What is claimed is:

1. An applicator system for caring for a cuticle comprising:
a housing comprising:
a first portion having a reservoir for containing a product; and
a second portion having a dispensing mechanism to discharge the product;
an applicator comprising:
a neck coupled to a distal end of the first portion of the housing;
a tip coupled to a distal end of the neck, the tip including an application surface, a distal end, and a manipulation surface, the manipulation surface including a face extending between the application surface and the distal end, the application surface configured for applying the product to the cuticle and substantially surrounding a product delivery passageway, wherein the manipulation surface is configured for operating on the cuticle, wherein the face of the manipulation surface is concave and wherein the manipulation surface extends away from the application surface; and
a product delivery passageway extending between the reservoir and the application surface of the tip, the product delivery passageway configured to allow the product to be transported from the reservoir to the application surface of the tip.

2. The applicator system as recited in claim 1, wherein the housing comprises one or more of metal, plastic, glass, wood, or a combination thereof.

3. The applicator system as recited in claim 1, wherein the dispensing mechanism comprises one of:
a reverse click motion delivery mechanism;
a twist motion delivery mechanism;
a pen click delivery mechanism;
an airless pump delivery mechanism; or
an aerosol delivery mechanism.

4. The applicator system as recited in claim 1, wherein the neck and the tip are manufactured as one integral unit.

5. The applicator system as recited in claim 1, wherein the manipulation surface of the tip comprise one of:
a surface configured to push back the cuticle toward a nail bed;
a surface configured to trim or cut the cuticle; or
a surface configured to massage the product into the cuticle.

6. The applicator system as recited in claim 1, wherein the neck is made of a first material and the tip is made from a second material.

7. The applicator system as recited in claim 1, wherein the tip is detachable from the neck of the applicator.

8. The applicator system as recited in claim 7, further comprising a second tip which is interchangeable with the tip to perform an alternative manipulation to the cuticle.

9. The applicator system as recited in claim 1, wherein the application surface of the tip comprises a material capable of retaining heat or cold during application of the product.

10. The applicator system as recited in claim 1, further comprising a cap, wherein the cap is temporarily attachable to the first portion of the housing and having a plug configured to seal the product delivery passageway.

11. A cosmetic dispenser comprising:
a housing comprising a container for storing a cosmetic or medicinal product and a product delivery mechanism for dispensing the product;
a cuticle care tip attached to the housing, the cuticle care tip including an application surface, a distal end, and a manipulation surface, the manipulation surface including a face extending between the application surface and the distal end, wherein the application surface includes a product orifice disposed in and substantially flush with the application surface, wherein the face of the manipulation surface is concave relative to the application surface and wherein the manipulation surface extends away from the application surface; and wherein the cuticle care tip further includes a product delivery duct to allow movement of the product from the container to the product orifice on the application surface of the cuticle care tip.

12. The dispenser of claim 11, wherein the product delivery mechanism to dispense the product comprises one of:
a reverse click motion delivery mechanism;
a twist motion delivery mechanism;
a pen click delivery mechanism;
an airless pump delivery mechanism; or
an aerosol delivery mechanism.

13. The dispenser as recited in claim 12, wherein the manipulation surface of the cuticle care tip further comprises at least one of:
one or more protrusions for pushing back a cuticle toward a nail bed;
a surface for trimming or cutting the cuticle; or
a surface for massaging the product into the cuticle.

14. The dispenser as recited in claim 12, further comprising a second cuticle care tip which is interchangeable with the tip, the second cuticle care tip comprising an alternative manipulation surface.

15. The dispenser as recited in claim 11, wherein the tip further comprises a material that is at least one of:
coated with an antimicrobial or antiseptic agent;
non-reactive or resistant to the product; or
capable of retaining heat or cold during application of the product.

16. A cuticle care system comprising:
a housing having a reservoir for containing a product, the housing comprising a material responsive to pressure by a user;
a plurality of interchangeable tips interchangeably couplable to the housing, wherein each of the plurality of interchangeable tips comprises:
a longitudinal axis;
an application surface for applying the product to a surface, the application surface including a length extending along the longitudinal axis;
a manipulation surface extending away from the application surface, the manipulation surface including a face and a length extending along the longitudinal axis, wherein the face of the manipulation surface is concave and wherein the length of the manipulation surface is longer than the length of the application surface; and
a product transfer duct positioned along the application surface, the transfer duct configured to transport the product from the reservoir to the application surface.

17. The system as recited in claim 16, further comprising a product delivery mechanism wherein the product is delivered from the reservoir through the product transfer duct to the application surface when pressure is applied to the housing.

18. The system as recited in claim 16, wherein each of the plurality of interchangeable tips further comprise one of a plurality of manipulation surfaces, each manipulation surface configured to:
push back a cuticle toward a nail bed;
trim or cut the cuticle; or
massage the product into the cuticle.

19. The system as recited in claim 16, wherein each of the plurality of interchangeable tips further comprises a material that is at least one of:

coated with an antimicrobial or antiseptic agent;

non-reactive or resistant to the product; or capable of retaining heat or cold during application of the product.

20. The system as recited in claim 16, wherein the application surface of each of the plurality of interchangeable tips further comprises different surface treatment, textures, finishes, contours, or combinations thereof.

* * * * *